United States Patent [19]

Orii et al.

[11] Patent Number: 4,912,806

[45] Date of Patent: Apr. 3, 1990

[54] DOOR CHECK

[75] Inventors: Makoto Orii; Katsuhiko Hayashi, both of Nagano, Japan

[73] Assignee: Kabushiki Kaisha Sankyo Seiki Seisakusho, Nagano, Japan

[21] Appl. No.: 157,665

[22] Filed: Feb. 19, 1988

[30] Foreign Application Priority Data

Feb. 20, 1987 [JP] Japan ..... 62-37029

[51] Int. Cl.[4] ..... E05F 3/00

[52] U.S. Cl. ..... 16/64; 16/49

[58] Field of Search ..... 16/64, 69, 62, 49, 79, 16/DIG. 10, 77

[56] References Cited

U.S. PATENT DOCUMENTS

| | | | |
|---|---|---|---|
| 1,129,712 | 2/1915 | Neyer | 16/62 |
| 1,353,219 | 9/1920 | Collins | 16/64 |
| 1,818,655 | 8/1931 | Summerfield | 16/49 |
| 1,918,879 | 7/1933 | Welton | 16/64 |

FOREIGN PATENT DOCUMENTS

| | | | |
|---|---|---|---|
| 376796 | 5/1964 | Switzerland | 16/77 |

*Primary Examiner*—Nicholas P. Godici
*Assistant Examiner*—Carmine Cuda
*Attorney, Agent, or Firm*—Sughrue, Mion, Zinn, Macpeak & Seas

[57] ABSTRACT

A door check is disclosed which comprises a first arm pivotally attached at one end thereof to a door which is able to be opened and closed as desired; a second arm pivotally attached at one end thereof to the first arm, the other end of the second arm being pivotally attached to a door frame for supporting the door in such a manner that the door is able to be opened and closed as desired; a driving force storing spring retained by either the first or second arm and biased in response to the pivotal motion of the door in the opening direction so as to store force for driving the door in the closing direction; a gear train for transmitting the rotation of the door when opened to said driving force storing spring and also transmitting the driving force stored in the driving force storing spring to the door; a brake rotated by means of the force released from the driving force storing spring to apply a brake force to the force; and a speed increasing gear train coupled at its starting end to said driving force storing spring to transmit the force released from the driving force storing spring to the brake after increasing the speed thereof. The speed increasing gear train has a worm in the final stage thereof.

4 Claims, 6 Drawing Sheets

DOOR CHECK

BACKGROUND OF THE INVENTION

The present invention relates to a door check designed to close automatically an open door. The door check may be applied to various units such as house doors, kitchen closures, entrance/exist doors or baggage space closures of aircrafts, buses or any other vehicles.

Most of conventional closers which have heretofore been put into practical use are of the oil cylinder type in which a piston is slidably received in a cylinder accommodating a spring and the oil. When the door is opened, the spring is deformed to store energy, whereas, when the door is closed, a damper effect is applied to the closing door by the use of the fluid resistance of the oil.

There has also been proposed a mechanical door check in which, when the door is opened, a spring is deformed to store energy, and when the door is closed, the force released from the spring is transmitted to a mechanical, centrifugal governor or an electromagnetic governor after the speed thereof has been increased through a speed increasing gear train to thereby apply a damper effect to the closing door (see, for example, Japanese Patent Publication No. 52-21810 (1977)).

Further, Japanese Patent Publication No. 52-3227 (1977) discloses a friction brake type door check.

The oil cylinder type door check has the problem that the damper effect varies with the change in room temperature because this type of door check utilizes the fluid resistance of the oil sealed in the cylinder to obtain a damper effect. More specifically, when the temperature rises, the viscosity of the oil lowers, so that the fluid resistance lowers and the door closing speed therefore increases, whereas, when the temperature lowers, the fluid resistance of the oil rises and therefore the door closing speed lowers. For this reason, it is necessary in the case of the conventional oil cylinder type door check to adjust the door closing speed. The oil cylinder type door check also suffers from the disadvantage that the sealed oil may leak, which means that this type of door check is inferior from the viewpoint of durability. Further, since it is necessary to prepare a casing including a cylinder which is able to endure large spring force and high oil pressure, the size and weight of the door check itself increase unavoidably. If the door check is heavy, the mounting operation becomes troublesome.

The mechanical door check is free from the above-described problems, that is, variations in the damper effect with the change in temperature and the leakage of the oil, but it has the problem that the overall size is disadvantageously large because it is necessary in order to obtain a predetermined speed increase ratio to dispose a large number of gears between the spring and the governor. If the speed increasing gear train is formed using spur gears, the gear train becomes long and the inertia of the gear train when rotated increases, so that, when the door is opened and closed, the gear train does not start rotating smoothly. Thus, this type of door check suffers from inferior operability (feeling) in opening and closing the door.

Regardless of the type, door checks are demanded not only to have functional characteristics that it is possible to open the door with light force and with good feeling, not to mention that it is possible to close the door reliably, but also to have an external appearance which does not damage the appearance of the door and the surroundings.

OBJECTS AND SUMMARY OF THE INVENTION

It is an object of the present invention to provide a door check which is free from variations in the damper effect with the change in room temperature and the fear of oil leakage and which is small in size and light in weight as well as having superior operability.

The present invention provides a door check comprising: driving force storing means biased in response to the pivotal motion of the door in the opening direction so as to store force for driving the door in the closing direction; a gear train for transmitting the rotation of the door when opened to the driving force storing means and also transmitting the driving force stored in the driving force storing means to the door; braking means rotated by means of the force released from the driving force storing means to apply brakes to the force and a speed increasing gear train coupled at its starting end to the driving force storing means to transmit the force released from the driving force storing means to the braking means after increasing the speed thereof, the speed increasing gear train having a worm in the final stage thereof.

When the door is opened, the driving force storing means is biased through the gear train. When the door opening operation is canceled, the door is pivoted in the closing direction by means of the driving force stored in the driving force storing means. At this time, the force released from the driving force storing means is braked by the braking means activated through the speed increasing gear train. The worm which is provided at the terminating end of the speed increasing gear train causes the braking means to rotate at an increased speed.

DESCRIPTION OF PREFERRED EMBODIMENTS

Figure 1:
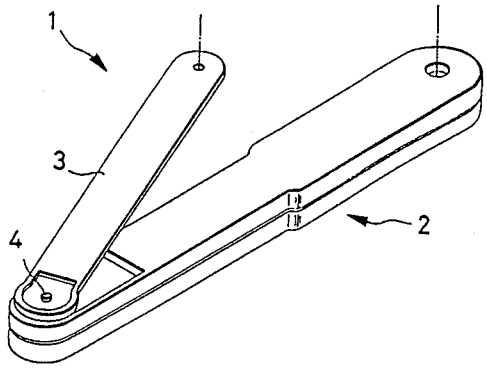
FIG. 1 is a perspective view schematically showing the door check according to the present invention.

The present invention will be described hereinunder in detail by way of one embodiment which is illustrated in the drawings.

Figure 2:
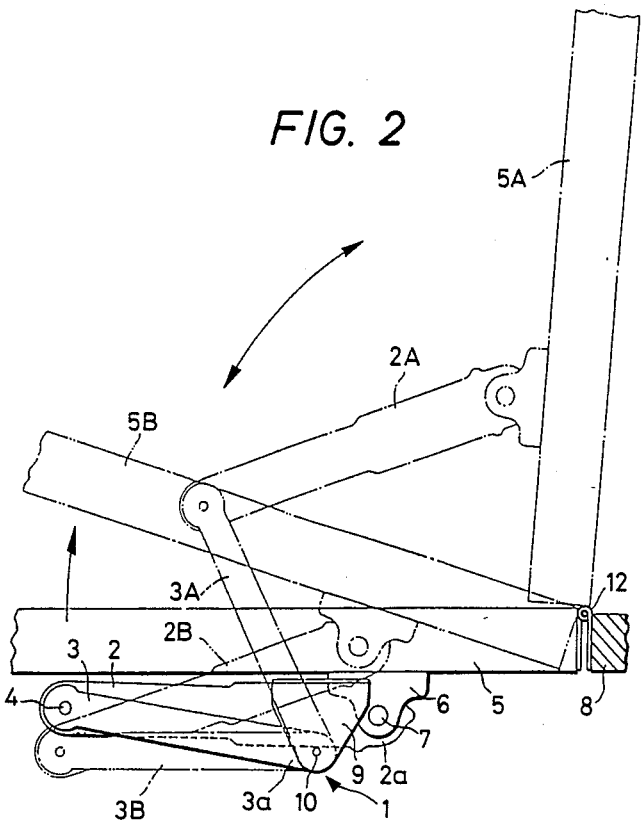
FIG. 2 is a schematic plan view showing different open and closed positions of the door and the position of the door check which changes in accordance with the position of the door.

Referring to FIG. 1, a door check 1 comprises a first arm 2 and a second arm 3, which are pivotally connected together through an arm shaft 4. As shown in FIG. 2, the first arm 2 is pivotally attached at one end 2*a* to a door 5 through a first arm mounting member 6 rigidly secured to the door 5 and a first shaft 7. The other end 3*a* of the second arm 3 is pivotally attached to a door frame 8 through a second arm mounting member 9 rigidly secured to the door frame 8 and a pin 10. The door 5 is supported by the door frame 8 through a door hinge 12 in such a manner that the door 5 can be freely opened and closed. In FIG. 2, the solid line shows the door 5 which is closed, while the one-dot chain line 5A shows the door which is opened at substantially 90 degrees, and the two-dot chain line 5B shows the door which is at a position where brakes are started to be applied to the closing door (or a position where the door is slightly opened). As illustrated, the relative position of the first and second arms 2, 3 changes in accordance with the position of the door which is opened and closed. It should be noted that, although the door 5 can be opened more than 90 degrees, in FIG. 2 the opened door 5A is drawn in the 90 degree position due to the convenience of illustration.

The arrangement of the door check 1 will next be explained in detail with reference to FIGS. 3, 4 and 5.

The second arm mounting member 9 is rigidly secured at a bent portion 9*a* thereof to the upper frame member of the door frame 8 (see FIG. 2). The second end 3*a* of the second arm 3 is pivotally attached to the mounting member 9 through the pin 10. The first arm 2 consists of an upper casing member 2*b* and a lower casing member 2*c*, which are laid one upon the other and then secured together by means of a plurality of securing screws 13. The first shaft 7, which is defined by a square shaft, is passed through the first end 2*a* of the first arm 2, both ends of the first shaft 7 being fitted into square bores 6*a*, respectively, in the first arm mounting member 6 and then secured by means of respective screws 14. The first arm mounting member 6 is a bent member having a U-shaped cross-section which is secured at a base portion 6*b* thereof to an appropriate portion of the door 5 (see FIG. 2). The arm shaft 4 is passed through the first end 3*b* of the second arm 3 and the second end 2*d* of the first arm 2 to pivotally attach these two arms to each other. An E-ring 15 is engaged with one end of the arm shaft 4, the other end of the arm shaft 4 being press-fitted. The first shaft 7 positioned inside the first arm 2 supports a first gear 16 which is fitted thereon through a square bore 16*a* thereof. Accordingly, the first gear 16 is substantially integral with the door 5 (see FIG. 2) through the first arm mounting member 6. Boss portions 16*b* which are formed at both ends of the first gear 16 are rotatably fitted in shaft bores 2*e* provided in the upper and lower casing members 2*b*, 2*c*, respectively.

In the lower casing member 2*c* is disposed a driving force storing means 21 which consists of a spring housing box 17, a fourth shaft 18 serving as a driving force output shaft and a spring 19 (see FIG. 9) retained at one end 19*a* thereof by an engagement notch 17*a* in the housing box 17 and at the other end 19*b* thereof by a retainer pin 20 which is rigidly built in the fourth shaft 18. A cover 17*b* is rigidly secured to the spring housing box 17. The cover 17*b* is fastened to the lower casing member 2*c* by means of fixing screws 22 to thereby secure the spring housing box 17. The fourth shaft 18 is supported by the spring housing box 17 in such a manner that the shaft 18 is prevented from axially moving but allowed to rotate freely. One end of the fourth shaft 18 projects from the cover 17*b* to define a projecting end 18*a* which has its peripheral surface partially cut so as to engage with and thereby support a fourth gear 23, the gear 23 serving as an output gear.

Between the fourth gear 23 and the first gear 16 is disposed a gear train 26 consisting of a second gear 24 and a third gear 25. The second and third gears 24, 25 are rotatably supported at respective ends by second and third shafts 27, 28, respectively, which are fitted into the upper and lower casing members 2*b*, 2*c*. The second gear 24 consists of a small-diameter toothed portion 24 which is meshed with the first gear 16 and a large-diameter toothed portion 24*b* which is meshed with a small-diameter toothed portion 25*a* of the third gear 25. The third gear 25 consists of the small-diameter toothed portion 25*a* and a large-diameter toothed portion 25*b* which is meshed with the fourth gear 23. This gear train 26 is arranged such that, when the door is opened, the rotation of the first gear 16 is transmitted to the fourth shaft 18 after the speed thereof has been increased to wind up the spring 19 to thereby store energy therein, whereas, when the door is closed, the force released from the spring 19 is transmitted to the first gear 16 after the speed thereof has been reduced, as described later in detail.

The first arm 2 is provided with a braking means 29. The braking means 29 consists of a worm shaft 31 formed with a worm 30, a pair of friction plates 32 press-fitted on the worm shaft 31, a friction plate holder 33 press-fitted on the shaft 31, a friction plate retaining ring 34, and a braking cup 35 disposed in close proximity with the outer peripheral edges of the friction plates 32 such as to surround them. The braking cup 35 is secured in such a manner that flanges 35*a* formed thereon are press-fitted into fitting grooves 2*f*, respectively, formed in the lower casing member 3*c* and fitting grooves (not shown) formed in the upper casing member 2*b*. The worm shaft 31 is rotatably supported in such a manner that one end 31*a* thereof is fitted into a bearing bore formed in the ceiling portion of the cup 35 and the other end 31*b* is fitted into a bearing groove 2*g* formed in the lower casing member 2*c*. A shaft retaining portion (not shown) which is formed on the upper casing member 2*b* is engaged with the bearing groove 2*g* to thereby support the shaft end 30*b* engaged with the groove 2*g*. The friction plates 32 are, in the illustrated example, formed from an elastic material defined by a rubber or rubber-like material. Each friction plate 32 has comma-shaped arm portions 32*a* which extend in opposite directions and which are elastically deformable. When the worm shaft 31 is rotating at a predetermined speed or less, the outer peripheral edges of the arm portions 32*a* are separate from the inner peripheral surface of the cup 35, whereas, when the rotation of the worm shaft 31 exceeds the predetermined speed, the arm portions 32*a* are elastically deformed radially outward by the centrifugal force so as to come into sliding contact with the inner peripheral surface of the braking cup 35, thus braking the rotation of the shaft 31.

Between the driving force storing means 21 and the braking means 29 is disposed a speed increasing gear train 38 which includes a one-way clutch means 36 and an intermittent transmission means 37.

The speed increasing gear train 38 consists of a fifth gear 39 having a relatively large diameter which is meshed with the fourth gear 23, a sixth gear 40 having a relatively small diameter which is composed of a full toothed portion 40*a* and a sector gear portion 40*b* having one tooth 40*c*, a seventh gear 41 having a relatively large diameter which is composed of a first toothed portion 41*a* which is meshed with the full toothed portion 40*a* and a second toothed portion 41*b* which is meshed with the tooth 40*c*, an eighth gear 42 having a small-diameter toothed portion 42*a* which is meshed with either the first toothed portion 41*a* or the second toothed portion 41*b* and a large-diameter toothed portion 42*b*, a ninth gear 43 having a relatively small diameter which is meshed with the large-diameter toothed portion 42*b*, a worm gear 44 which constitutes the one-way clutch means 36 in combination with the ninth gear 43, and the above-described worm 30 which defines the final stage of the speed increasing gear train 38. This gear train 38 is arranged to transmit the force released from the spring 19 of the driving force storing means 21 to the worm shaft 31 of the braking means 29 after increasing the speed thereof. It should be noted that the speed increasing gear train 38 in the illustrated embodiment does not always transmit the force released from the spring 19 after increasing the speed thereof since the intermittent transmission means 37 and one-way clutch means 36 (described later) are incorporated in the gear train 38.

The fifth gear 39 is rotatably supported through a support shaft 45 which is rigidly built in the cover 17*b* of the spring housing box 17. The other end of the support shaft 45 is fitted into the upper casing member 2*b*. The sixth gear 40, the seventh gear 41, the eighth gear 42 and the combination of the ninth gear and the worm gear 44 are rotatably supported through a sixth shaft 46, a seventh shaft 47, an eighth shaft 48 and a ninth shaft 49, respectively, which are engaged at both ends thereof with the upper and lower casing members 2*b*, 2*c*.

The one-way clutch means 36 is a spring clutch having an input portion defined by the ninth gear 43 and an output portion defined by the worm gear 44. A coil spring 50 is wound on a tubular portion 43*a* of the gear 43, one end 50*a* of the spring 50 being retained by a notch 43*b*. The spring 50 has its coil portion brought into sliding contact with the inner peripheral surface 44*a* (see FIG. 4) of the worm gear 44, so that, when the ninth gear 43 rotates in the direction of the arrow a (see FIG. 3) as the door is opened, the spring 50 rotates in a direction in which it is wound up to reduce its diameter and therefore the rotation of the ninth gear 43 is not transmitted to the worm gear 44. When the ninth gear 43 rotates in the reverse direction to the arrow a as the door is closed, the coil spring 50 is released to recover its basic position, so that the rotation of the gear 43 is transmitted to the worm gear 44 to rotate the worm 30 at an increased speed.

The intermittent transmission means 37 is incorporated as a part of the speed increasing gear train 38, that is, it consists of the sixth gear 40, the seventh gear 41 and the eighth gear 42. As shown in FIGS. 3, 5, 7 and 8, the full toothed portion 40*a* is formed at the axially upper half of the sixth gear 40, and the sector gear portion 40*b* having one tooth 40*c* is formed at the axially lower half of the gear 40. The tooth 40*c* is formed so as to be continuous with one tooth of the full toothed portion 40*a*. The seventh gear 41 consists of a first toothed portion 41*a* having a first untoothed portion 41*c* formed along a half of the circumference of the axially upper half of the gear 41, a second toothed portion 41*b* having a second untoothed portion 41*d* formed along a half of the circumference of the axially lower half of the gear 41, and a full untoothed portion 41*f* formed at the lower end of the second toothed portion 41*b* and having the same diameter as that of the second untoothed portion 41*d*. Teeth which are located at both ends of the first toothed portion 41*a* are formed so as to be continuous with teeth located at both ends of the second toothed portion 41*b*, as denoted by the reference numerals 41*e*. The tooth thickness of the small-diameter toothed portion 42*a* of the eighth gear 42 is set at such a value that the toothed portion 42*a* is able to mesh with the second toothed portion 41*b* of the seventh gear 41. A circumferential portion 42*c* which has a slightly larger diameter than that of the tip circle of the small diameter toothed portion 42*a* is formed at the lower end of the toothed portion 42*a* of the eighth gear 42. The circumferential portion 42*c* is provided with a projection 42*e* having a circular portion 42*d* (see FIG. 6) which has a slightly larger diameter than that of the full untoothed portion 41*f* of the seventh gear 41. Thus, when the full toothed position 40*a* of the rotating sixth gear 40 is in engagement with the first toothed portion 41*a* of the seventh gear 41, the rotation of the gear 40 causes the seventh gear 41 to rotate tooth by tooth, whereas, when the tooth 40*c* faces the first untoothed portion 41*c*, the tooth 40*c* engages with the second toothed portion 41*b* of the seventh gear 41 to rotate the gear 41 at a rate of two teeth per full turn of the sixth gear 40. When the projection 42*e* of the eighth gear 42 faces the full untoothed portion 41*f* of the seventh gear 41 (see FIG. 6), the rotation of the seventh gear 41 is not transmitted to the eighth gear 42. This intermittent feed operation will be described later in detail.

Figure 3:
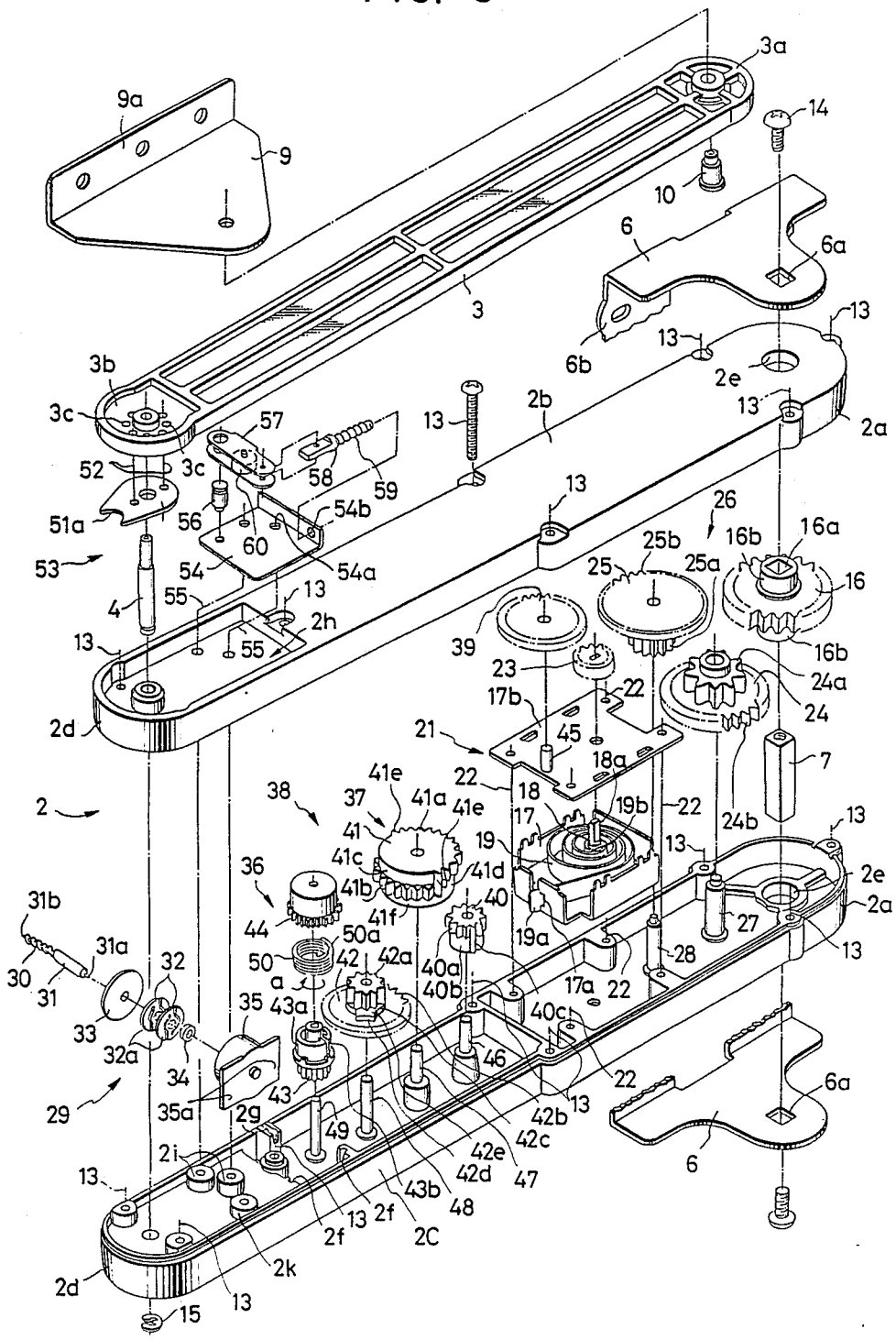
FIG. 3 is an exploded perspective view of the door check according to the present invention.
Figure 4:
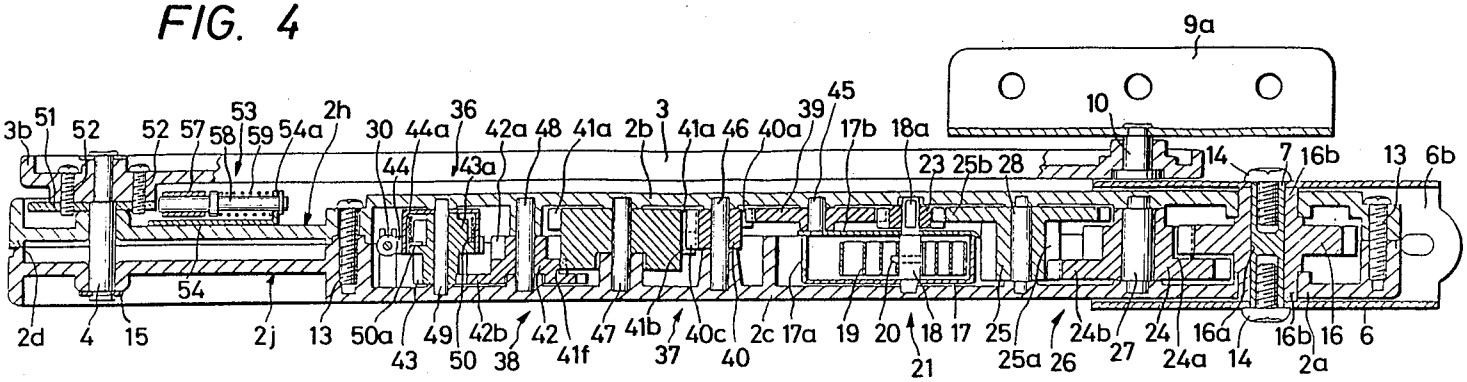
FIG. 4 is a vertical sectional view of the door check.
Figure 10:
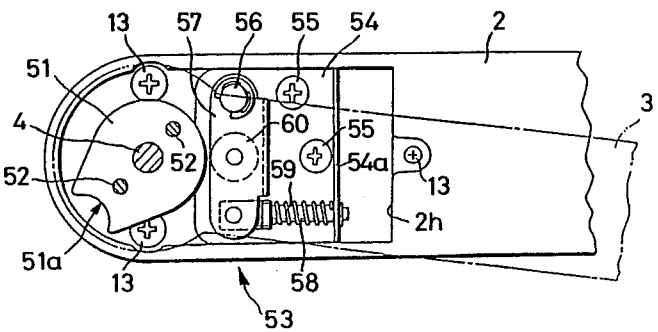
FIG. 10 is a plan view showing one example of the door positioning means shown in FIG. 10 which is in an operative state wherein the door is stopped and held thereby at a predetermined open position.

Referring to FIGS. 3, 4 and 10, a stopper mounting recess 2*h* is formed at the second end 2*d* of the upper casing member 2*b*. The stopper mounting recess 2*h* accommodates a door positioning means 53 for stopping and holding the opened door 5 at a predetermined open position. A positioning cam 51 which is fitted on the arm shaft 4 is rigidly secured to the lower surface of the first end 3*b* of the second arm 3 by means of screws 52. A recess 51*a* is formed in the positioning cam 51. A base plate 54 is rigidly secured to the bottom of the recess 2*h* by means of screws 55. The screws 55 extend through the upper casing member 2*b* and are screwed into internally threaded portions 2*i*, respectively, which are formed on the lower casing member 2*c*. A stopper lever 57 is pivotally attached to the base plate 54 by means of a pin 56 which is rigidly built in the plate 54. A shaft 58 is pivotally attached to the free end of the stopper lever 57. One end of the shaft 58 is slidably received in a guide bore 54*b* provided in a rising portion 54*a* of the base plate 54. An expansion coil spring 59 is provided on the shaft 58 so as to extend from the step portion of the shaft 58 to the rising portion 54*a*, thus biasing the stopper lever 57 toward the arm shaft 4. A cam follower 60 is rotatably attached to the stopper lever 57. The cam follower 60 is pressed at the peripheral surface thereof against the positioning cam 51 by means of the resilient force of the coil spring 59. However, they are separate from each other in the illustration of FIG. 10.

The positioning cam 51 enables the open position of the door 5 to be set as desired by selecting a mounting angle of the cam 51 with respect to the second arm 3. The mounting angle of the cam 51 is determined by selecting one of a plurality of mounting bores 3*c* formed in the second end 3*b* of the second arm 3.

The following is a description of the operation of the embodiment arranged as detailed above.

Figure 9:
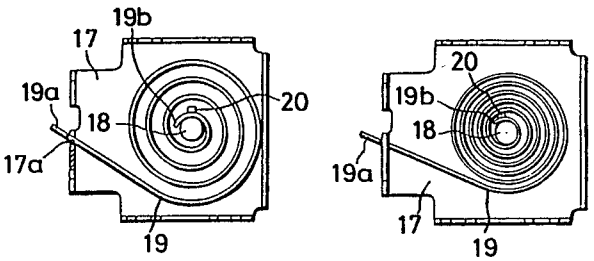
FIGS. 9(*a*) and 9(*b*) are plan views employed to describe the spring of the driving force storing means.

Referring to FIG. 2, when the door 5 is in the closed position, the door closer 1 is in a folded state with the first and second arms 2, 3 superposed one on the other, as shown by the solid line. FIG. 5 shows the relative position of the various means and gear trains accommodated in the first arm 2 at this time. More specifically, the spring 19 of the driving force storing means 21 is in an unwound state as shown in FIG. 9(*a*). However, the spring 19 which is in this state has not completely released the stored energy but still has some biasing force. In the intermittent transmission means 37, the teeth 41*e* which are continuous at both ends of the first and second toothed portions 41*a*, 41*b* of the seventh gear 41 are in engagement with the full toothed portion 40*a* of the sixth gear 40 and the small-diameter toothed portion 42*a* of the eighth gear 42. The tooth 40*c* of the sixth gear 40 is at the illustrated position, and the projection 42*e* of the eighth gear 42 is also at the illustrated position. The positioning cam 51 for stopping and holding the door 5 at a predetermined open position is placed at the position shown in FIG. 10. It should be noted that, in FIG. 10, the positioning cam 51 is assumed to be mounted on the second arm 2 so as to maintain the door 5 at a 120-degree opened position with respect to the closed position by way of example.

When the door 5 placed in the solid-line position shown in FIG. 2 is pivoted toward the two-dot chain line position, that is, when the door 5 is opened, the first gear 16 is revolved about the door hinge 12 through the first arm mounting member 6 which is integral with the door 5. In consequence, the second gear 24 which is in engagement with the first gear 16 is rotated in the direction of the solid-line arrow. The rotation of the second gear 24 is transmitted to the fourth gear 23 through the third gear 25. That portion of the gear train which extends from the fourth gear 23 to the second gear 24 inclusive functions as a speed increasing gear train when the rotation is transmitted from the second gear 24 to the fourth gear 23, so that the fourth gear 23 is rotated through an increased angle of rotation for a given angle of rotation of the second gear 24. The rotation of the fourth gear 23 causes the fourth shaft 18 to rotate so as to wind up the spring 19 having one end thereof retained thereby, thus storing driving force.

Figure 5:
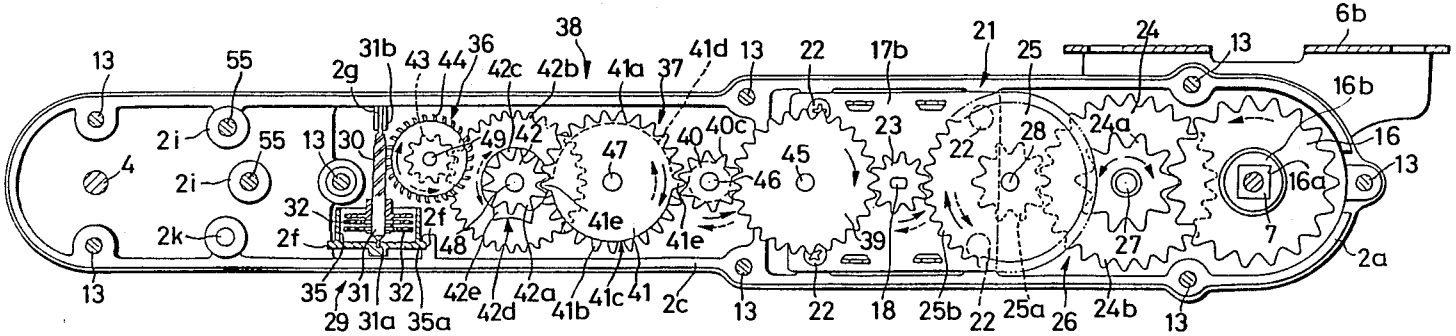
FIG. 5 is a horizontal sectional view showing the door check when the door is placed in the closed position.

Referring to FIG. 5, when the fourth gear 23 is rotated in the direction of the solid line arrow, the fifth gear 39 meshed therewith is rotated, thus causing the sixth gear 40 to rotate in the direction of the solid line arrow. Since the sixth gear 40 has its full toothed portion 40*a* engaged with the first toothed portion 41*a* of the seventh gear 41, the gear 40 causes the seventh gear 41 to rotate in the direction of the solid-line arrow. Since, at this time, the seventh gear 41 has its second toothed portion 41*b* meshed with the eighth gear 42, the gear 41 causes the gear 42 to rotate in the direction of the solid-line arrow. The eighth gear 42 which has its large-diameter toothed portion 42*b* meshed with the ninth gear 43 causes the gear 43 to rotate in the direction of the solid-line arrow. In consequence, the coil spring 50 (see FIG. 3) is rotated in the direction of the arrow a and thereby wound up, resulting in a lowering in the frictional force generated between the coil portion of the spring 50 and the inner peripheral surface 44*a* of the worm gear 44, so that it becomes impossible to rotate the worm gear 44 meshed with the worm 30. Therefore, when the worm gear 44 meshed with the worm 30. Therefore, when the door 5 is opened, the one-way clutch means 36 acts to cut off the speed increasing gear train 38 at an intermediate portion thereof, so that the braking means 29 is not activated. Accordingly, it is possible to reduce the force required to open the door 5.

Figure 6:
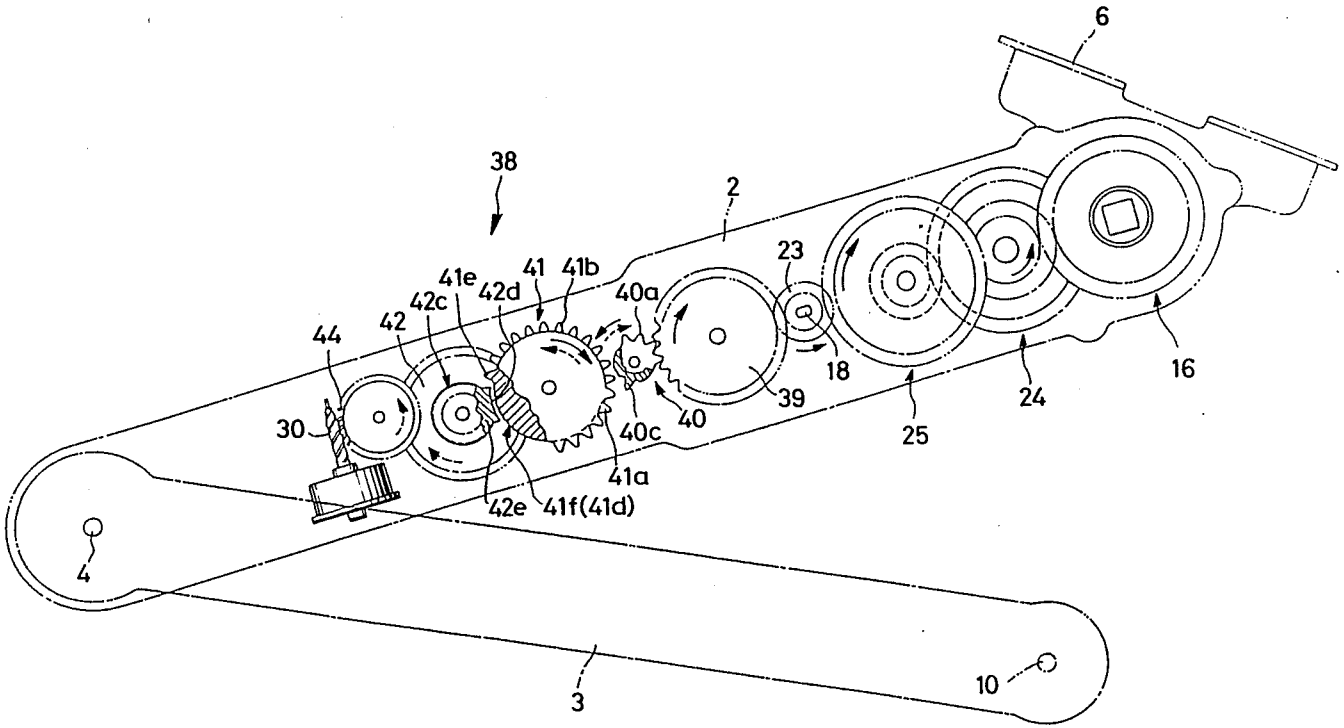
FIG. 6 is a plan view showing a gear train when the door is slightly opened (or in a position immediately before the closed position)

When the door 5 is opened as far as the position shown by the two-dot chain line 5B in FIG. 2, each of the gears constituting the speed increasing gear train 38 changes its position as shown in FIG. 6. It should be noted that the angle made between the two arms at the positions shown by the two-dot chain line in FIG. 2 is made different from the angle between the arms shown in FIG. 6 due to the convenience of illustration.

The full toothed portion 40*a* of the sixth gear 40 which is rotated as the door 5 is opened meshes with the first toothed portion 41*a* of the seventh gear 41 to rotate it in the direction of the solid-line arrow. When the seventh gear 41 is rotated as far as the position where the first toothed portion 41*a* disengages from the full toothed portion 40*a* of the sixth gear 40 as shown in FIG. 6, the eighth gear 42 which is rotated through the second toothed portion 41*b* is rotated as far as the position where the projection 42*e* thereof faces the seventh gear 41 as shown in FIG. 6, and the small-diameter toothed portion 42*a* is thereby disengaged from the second toothed portion 41*b* of the seventh gear 41. It should be noted that the full untoothed portion 41*f* of the seventh gear 41 is provided with a recess (not shown) for receiving the projection 42*e* so that the projection 42*e* when revolved is able to face the untoothed portion 41*f*.

As shown in FIG. 6, the sixth gear 40 is rotated in the direction of the solid-line arrow as the door 5 is opened even after the full toothed portion 40*a* of the sixth gear 40 has been disengaged from the first toothed portion 41*a* of the seventh gear 41. When the tooth 40*c* (see FIG. 3) of the rotating sixth gear 40 meshes with the second toothed portion 41*c* of the seventh gear 41 a shown in FIG. 7, the gear 41 is rotated through an angle corresponding to two teeth by the tooth 40*c*. The intermittent feed operation conducted by the tooth 40*c* of the sixth gear 40 is repeated until the door opening operation is completed, thus causing the seventh gear 41 to rotate under no load in the direction of the solid-line arrow. Since the seventh gear 41 thus fed intermittently has its full untoothed portion 41*f* facing the circular portion 42*d* of the eighth gear 42, the eighth and ninth gears 42, 43 do not rotate. Accordingly, after the seventh and eighth gears 41, 42 have been disengaged from each other, the user is released from the operation of winding up the coil spring 50, and it is therefore possible to open the door 5 even more easily.

Figure 11:
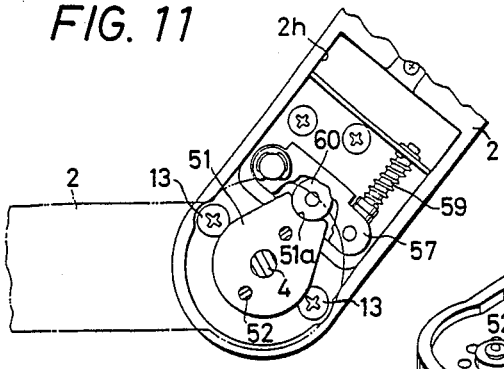
FIG. 11 is a plan view of the door positioning means; shown in FIG. 10 which is in an operative state wherein the door is stopped and held thereby at a predetermined open position.

Referring back to FIG. 2, when the door 5 which has been opened to the position shown by the two-dot chain line 5B is further pivoted as far as the position shown by the one-dot chain line 5A, the angle made between the first and second arms 2, 3 increases and the spring 19 is further wound up through the gear train 26 so as to store energy. When the door 5 is opened to the fully opened position, e.g., the 120-degree position with respect to the closed position, the positioning cam 51 pushes the positioning lever 57 and engages with the cam follower 60 at its recess 51*a*, as shown in FIG. 11. The cam follower 60 is fitted into the recess 51*a* by means of the resilient force of the coil spring 59 to restrict the rotation of the cam 51. Accordingly, the door 5 is stopped and held at a set open position. The door 5 can be released from the open position by forcedly pivoting the door 5 in the closing direction to thereby disengage the positioning cam 51 from the cam follower 60.

When the door 5 is released from the open position, or when the door 5 which has been opened to a position close to the predetermined open position is released from the pushing or pulling force, that is, when the user removes his hand from the door 5, the door 5 starts pivoting toward the closed position shown by the solid line 5 in FIG. 2. When the door 5 is opened, for example, to the position shown by the two-dot chain line 5A in FIG. 2, the spring 19 is wound up so as to store energy as shown in FIG. 9(*b*). The force released from the spring 19 causes the gear train 26 to rotate in the direction of the chain-line arrows in FIG. 5.

Figure 7:
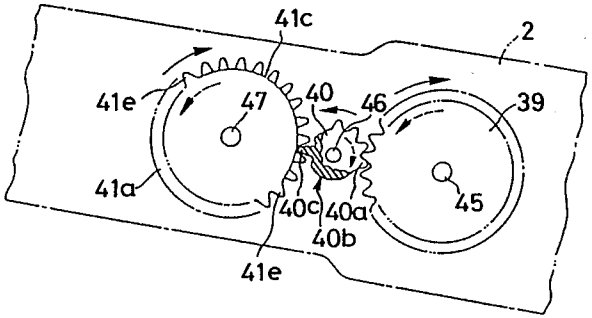
FIGS. 7 and 8 are plan views each showing the operation of a part of the speed increasing gear train.
Figure 8:
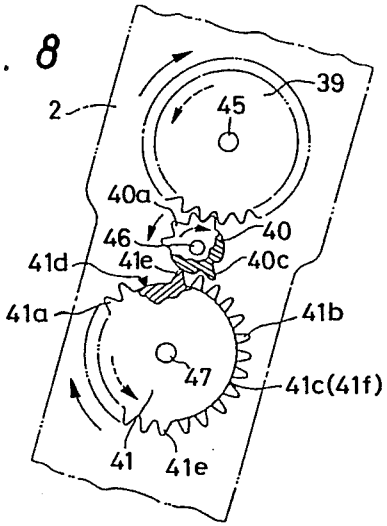

More specifically, the rotation of the fourth gear 23 rotated by the spring 19 is transmitted to the second gear 24 after the speed thereof has been reduced through the third gear 25, that is, with increased torque. The second gear 24 causes the first gear 16 to rotate in the direction of the chain-line arrow through the small-diameter toothed portion 24*a*. Since the first gear 16 is substantially integral with the door 5, the door 5 starts pivoting from the open position toward the closed position by means of the force released from the spring 19. As the fourth gear 23 rotates in the direction of the chain-line arrow, the fifth gear 39 meshed therewith causes the sixth gear 40 to rotate in the direction of the chain-line arrow as shown in FIG. 8. At this time, the first toothed portion 41*a* of the seventh gear 41 has its first untoothed portion 41*c* facing the full toothed portion 40*a* of the sixth gear 40; therefore, the seventh gear 41 is not rotated by the full toothed portion 40*a* of the rotating sixth gear 40. However, since the tooth 40*c* of the sixth gear 40 engages with the second toothed portion 41*b* of the seventh gear 41 as shown in FIG. 8, the seventh gear 41 is rotated in the direction of the chain-line arrow through an angle corresponding to two teeth as shown in FIG. 7.

The intermittent feed operation conducted by the tooth 40*c* of the sixth gear 40 continues until the full toothed portion 40*a* of the gear 40 reaches a position immediately before the position where it engages with the first toothed portion 41*a* of the seventh gear 41 (see FIG. 6).

Referring to FIG. 6, when the sixth gear 40 rotates in the direction of the chain-line arrow and the tooth 40*c* thereof causes the seventh gear 41 to rotate through an angle corresponding to two teeth, the full toothed portion 40*a* of the sixth gear 40 and the first toothed portion 41*a* of the seventh gear 41 mesh with each other, and thereafter, the seventh gear 41 is continuously rotated. When the seventh gear 41 starts continuously rotating, the second toothed portion 41*b* meshes with the small-diameter toothed portion 42*a* of the eighth gear 42 to rotate it in the direction of the chain-line arrow. The rotation of the eighth gear 42 causes the ninth gear 43 (see FIG. 5) meshed therewith to rotate in the direction of the chain-line arrow. The rotation of the ninth gear 43 causes the coil spring 50 to rotate in the reverse direction to the arrow a in FIG. 3. The rotation of the spring 50 in this direction causes its diameter to increase, resulting in the spring 50 coming into pressure contact with the inner peripheral surface of the worm gear 44. Since clutch coupling of the ninth gear 43 and the worm gear 44 is completed when the coil spring 50 which expands while slide-contacting the inner peripheral surface of the worm gear 44 comes into pressure contact with said inner peripheral surface, no shock is generated when the gears 43 and 44 are coupled together in one unit. After the clutch has been engaged, the worm gear 44 is rotated in the direction of the chain-link arrow as shown in FIGS. 5 and 6.

The worm gear 44 is rotated at increased speed by that portion of the speed increasing gear train 38 which extends from the fifth gear 39 to the worm gear 44, and the rotation of the worm gear 44 is transmitted to the worm shaft 31 after the speed thereof has been further increased through the worm 30. When the worm shaft 31 is rotated at high speed, the friction plates 32 supported thereon rotate at high speed. In consequence, the arm portions 32*a* (see FIG. 3) of the plates 32 are elastically deformed by centrifugal force and thus expanded, resulting in the arm portions 32*a* coming into sliding contact with the inner peripheral surface of the braking cup 35 to brake the rotation of the worm shaft 31.

The rotation of the gear train 26 rotated when the door 5 is closed is transmitted to the braking means 29 through the one-way clutch means 36 and the speed increasing gear train 37, so that the rotation of each of these gear trains is braked from the time when the braking means 29 is activated. More specifically, that the rotation of these gear trains is braked means that the first gear 16 meshed with the second gear 24 at the starting end of the gear train 26 is braked. In other words, brakes ar applied to the door 5 which is substantially integral with the first gear 16 and which pivots in the closing direction. Although no brakes are applied to the door 5 pivoting, for example, from the open position shown by the one-dot chain line 5A in FIG. 2 to the two-dot chain line position 5B (where the braking operation starts) immediately before the closed position, brakes are applied to the door 5 pivoting from the two-dot chain line position 5B to the closed position. As described above, the closing door 5 is braked because the rotation of the worm shaft 31 is braked by means of the friction plates 32, and when the braking operation starts, that is, when the worm gear 44 starts rotating the worm shaft 31, the friction plates 32 have not yet come into sliding contact with the inner peripheral surface of the cup 35, and therefore the worm shaft 31 starts rotating without any shock. Accordingly, the speed of pivoting of the door 5 at the time no brakes have yet been applied thereto changes smoothly to the pivoting speed of the door 5 at the time it starts being braked.

The door 5 which has been pivoted to the closed position shown by the solid line in FIG. 2 is placed in a state wherein each means and each gear train housed in the first arm 2 are at rest in their respect positions shown in FIG. 5.

Although in the illustrated embodiment the braking means 29 is defined by a combination of the friction plates 32 made of an elastic material and the braking cup 35, the braking means of the present invention is not necessarily limitative thereto and a known governor mechanism may also be employed, for example, a governor mechanism of the type using a whirling member rigidly secured to a worm shaft.

The combination of the friction plates 32 made of an elastic material such as a rubber or rubber-like material and the braking cup 35 provides unique effects explained below.

In general, when room temperature rises, the above-described elastic friction plates lower in hardness and become easy to deform elastically. On the other hand, a lubricating oil is applied to the area between each individual gear constituting each gear train and the associated support shaft, and when room temperature rises the viscosity of the oil lowers and the fluid resistance thereof decreases. Conversely, when the temperature lowers, the friction plates becomes difficult to deform, and the viscosity of the lubricating oil rises and the fluid resistance thereof increases. The lubricating oil and the friction plates effectively exhibit their temperature characteristics such as those described above at a place where there is a large temperature difference between summer and winter. In summer, the viscosity of the lubricating oil lowers and each gear train rotates under low resistance; therefore, the door pivoting in the closing direction tends to move relatively fast. However, the friction plates made of an elastic material are easy to deform because of lowered hardness and therefore expanded relatively early so as to come into sliding contact with the braking cup. In winter, phenomena opposite to those in summer occur. Accordingly, the speed of pivoting of the door which is closed while being braked is kept substantially uniform at all times irrespective of the level of atmospheric temperature, so that it becomes unnecessary to adjust the door closing speed in accordance with atmospheric temperature.

There are two ways of mounting a door to the door frame; the right-handed door structure in which the door is mounted so that it is opened rightward as shown in FIG. 2; and the left-handed door structure in which the door is opened leftward by being pivoted about the edge thereof at the side which is not shown in FIG. 2. If the door check 1 which is attached to a right-handed door as in the case of the embodiment is attached to a left-handed door, the direction of rotation of the gear trains is reversed and therefore it cannot be mounted as it is. In the illustrated embodiment, however, the first arm 2 is designed so that it can be used being turned upside down. More specifically, in the door check 1 assembled for a right-handed door as shown in FIG. 4, the E-ring 15 is removed from the arm shaft 4 to separate the second arm 3 from the first arm 2, and the door positioning cam 51 is once removed and then secured again in conformity with a desired door position maintaining angle for a left-handed door.

Figure 12:
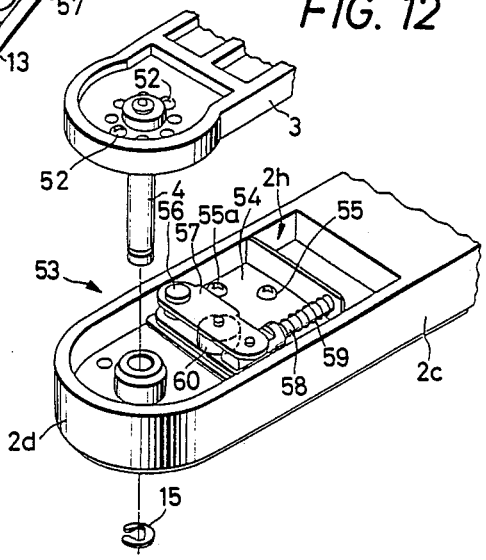
FIG. 12 is a fragmentary perspective view showing another example of the way in which the first and second arms are attached to each other.

Referring to FIGS. 4 and 12, a recess **2*j* for accommodating the door positioning means 53 is formed in the bottom surface of the first end 2*d* of the lower casing member 2*c* constituting the first arm 2. The recess 2*j* is provided with screw bores for thread engagement with screws 55 and 55*a* used to mount the base plate 54. The screw 55 is screwed into a central internal thread 2*i*, whereas the other screw 55*a* is screwed into an internal thread 2*k* (see FIG. 3). When the mounting of the positioning means 53 is completed, the second arm 3 is fitted to the first arm 2** to complete a door check for a left-handed door.

Further, although in the illustrated embodiment the first arm 2 accommodating the gear trains is attached to the door 5, this arm 2 may, of course, be attached to the door frame 8.

Figure 13:
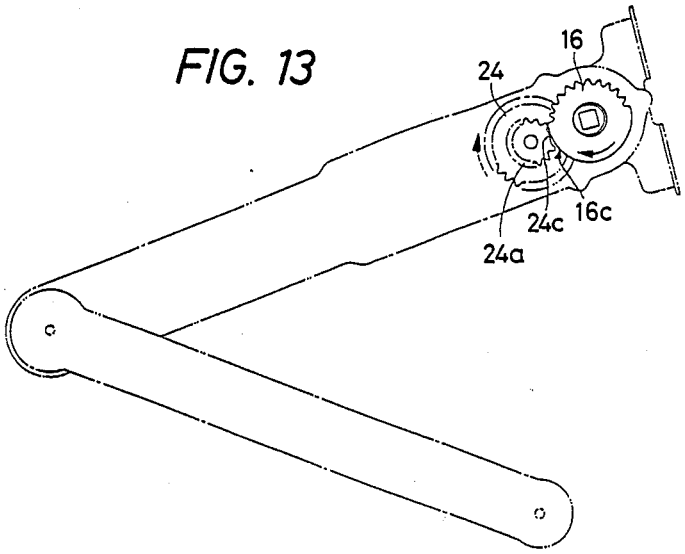
FIG. 13 is a view showing a primary part of the door tentatively stopping means.

A mechanism for stopping the door at any desired position when the door is opened will be explained with reference to FIG. 13. In this modification, the positioning means 53 having the stopper lever 57, the positioning cam 51 and the like are dispensed with, but instead thereof, tooth cutaway portions **16*c* and 24*c* are formed in the first gear 16 and the small diameter portion 24*a* of the second gear 24, respectively. The mechanism is so constructed that, when the door is opened through 80 degrees, the cutaway portions 16*c* and 24*c* are in opposition to each other. Therefore, the gear 16 is freely rotatably relative to the gear 24, so that no returning force is applied to the gear 24. It is therefore possible to stop the door at any desired position when the door has been rotated over 80 degrees. When the door is closed, the door is returned back to the position of 80 degree so that the gear 16 and the small diameter portion 24*a* are engaged with each other, and then the door is automatically closed by the returning force of the gear 24**.

As has been described above, the door check according to the present invention wherein a worm is provided in the final stage of a speed increasing gear train enables a reduction in the length of the speed increasing gear train for activating a braking means rotated at an increased speed and therefore permits the door closer itself to be reduced in both weight and size. Further, employment of a worm eliminates the fear of shock acting on the door when it is started to be braked, and therefore it is possible to provide a door check which enables the user to actuate the door with good feeling.

We claim:

1. A door check comprising:

input gear means for being rotated when a door rotates;

spring means for storing spring energy in accordance with rotation of said input gear means in a door opening direction;

means for transmitting to said input gear means release of the spring energy stored in said spring means;

means for braking the release of the spring energy;

a speed increasing gear train for the released spring energy to said braking means; and worm gear means having a worm mounted on a worm shaft provided at a final output stage of said speed increasing gear train;

said means for braking comprising:

deformable friction plates having arm portions integrally formed therewith, said plates being supported by said worm shaft; and a braking cup disposed at an end of said worm shaft so that said braking cup surrounds said plates;

said arm portions being elastically deformed when said worm shaft rotates at high speed so that said arm portions contact said braking cup causing braking of rotations of said worm shaft.

2. A door check comprising:

a first arm pivotably attached at one end thereof to a door which is able to be opened and closed as desired;

a second arm pivotably attached at one end thereof to said first arm, the other end of said second arm being pivotally attached to a door frame for supporting said door in such a manner that said door is able to be opened and closed as desired;

driving force storing means disposed in one of said first arm and said second arm, and biased in response to the pivotal motion of said door in the opening direction so as to store force for driving said door in the closing direction;

a gear train for transmitting the rotation of said door when opened to said driving force storing means and also transmitting the driving force stored in said driving force storing means to said door;

braking means rotated by means of the force released from said driving force storing means to apply brakes to said force; and a speed increasing gear train coupled at its starting end to said driving force storing means to transmit the force released from said driving force storing means to said braking means after increasing the speed thereof, said speed increasing gear train having a worm in the final stage thereof.

3. A door check as claimed in claim 2, wherein said worm is mounted on a worm shaft, and said means for braking comprises:

deformable friction plates having arm portions integrally formed therewith, said plates being supported by said worm shaft; and a braking cup disposed at an end of said worm shaft so that said braking cup surrounds said plates, said arm portions being elastically deformed when said worm shaft rotates at high speed so that said arm portions contact said braking cup causing braking of rotation of said worm shaft.

4. A door check as claimed in claim 2, wherein said force for driving said door in said closing direction in said driving force storing means is transmitted through said speed increasing gear train.

* * * * *